US006717345B2

(12) United States Patent
LaPeruta, Jr. et al.

(10) Patent No.: US 6,717,345 B2
(45) Date of Patent: Apr. 6, 2004

(54) METHOD AND APPARATUS FOR MAINTAINING SPACING BETWEEN TENSION FOCUS MASK STRANDS IN A TENSION FOCUS MASK

(75) Inventors: Richard LaPeruta, Jr., Lititz, PA (US); Edward Richard Garrity, Jr., Lancaster, PA (US); Donald Walter Bartch, York, PA (US); James Francis Edwards, Lancaster, PA (US)

(73) Assignee: Thomson Licensing S.A., Boulogne Cedex (FR)

( * ) Notice: Subject to any disclaimer, the term of this patent is extended or adjusted under 35 U.S.C. 154(b) by 432 days.

(21) Appl. No.: 09/742,616

(22) Filed: Dec. 21, 2000

(65) Prior Publication Data

US 2002/0079808 A1 Jun. 27, 2002

(51) Int. Cl.[7] ..... H01J 29/80
(52) U.S. Cl. ..... 313/407; 313/402
(58) Field of Search ..... 313/402, 407, 313/404; 445/24, 25

(56) References Cited

U.S. PATENT DOCUMENTS 5,613,889 A * 3/1997 Nosker et al. ..... 445/37
6,541,901 B2 * 4/2003 Gorog et al. ..... 313/407
2002/0145375 A1 * 10/2002 LaPeruta et al. ..... 313/402

* cited by examiner

*Primary Examiner*—Jay Patidar
(74) *Attorney, Agent, or Firm*—Joseph S. Tripoli; Carlos M. Herrera; Patricia A. Verlangieri

(57) ABSTRACT

A method and apparatus of maintaining spacing between tension focus mask strands in a tension focus mask. The method includes providing a tension focus mask comprising busbars with crosswires connected therebetween. A permanent adhesive is applied to the screen-side of the mask strands. Next, novel non-permanent horizontal guide members are attached to the gun-side of the mask strands, where an adhesive is applied to the guide member before the guide members are applied to the mask. The guide members maintain the vertical mask strand spacing during: (1) the application of the horizontal crosswires to the screen-side of the mask and (2) the subsequent thermal processing. The thermal processing cures the adhesive on the screen-side of the mask, thereby: (1) permanently attaching the crosswires to the mask strands and (2) volatilizing the adhesive on the gun-side of the mask strands such that the non-permanent guide member detach from the mask strands.

4 Claims, 2 Drawing Sheets

METHOD AND APPARATUS FOR MAINTAINING SPACING BETWEEN TENSION FOCUS MASK STRANDS IN A TENSION FOCUS MASK

This invention generally relates to color picture tubes and, more particularly, a method and apparatus for fabricating tension focus masks for color picture tubes.

BACKGROUND OF THE INVENTION

A color picture tube includes an electron gun for forming and directing three electron beams to a screen of the tube. The screen is located on the inner surface of the faceplate of the tube and is made up of an array of elements of three different color emitting phosphors. A color selection electrode mask, otherwise known as a shadow mask, is interposed between the gun and the screen to permit each electron beam to strike only the phosphor elements associated with that beam. A shadow mask is a thin sheet of material, such as steel, that is contoured to somewhat parallel the inner surface of the tube faceplate. A shadow mask may be either formed or tensioned. There are three types of tension mask systems: (1) strand tension mask; (2) tie bar tension mask; and (3) tension focus mask. A tension focus mask comprises two sets of conductive members that are perpendicular to each other and separated by an insulator. The two sets of members are held at different voltages; thus, creating electron focusing lenses within each rectangular space encompassed by two adjacent mask strands and two adjacent crosswires. A tension focus mask has at least one of the sets of conductive members under tension. Generally, in a tension focus mask, a vertical set of conductive members or mask strands is under tension and a horizontal set of conductive members or crosswires overlies the mask strands.

In assembling a tension focus mask, it is required to assemble the crosswires and mask strands with a high degree of accuracy to achieve consistent spacing between the mask strands and between the crosswires. If the spacing between vertical mask strands is consistent, then the tension focus mask will not exhibit macroscopic streaks, and as such, those macroscopic streaks will not be printed into the matrix and screening array.

SUMMARY OF THE INVENTION

The present invention provides a method and apparatus for assembling a tension focus mask and maintaining uniform spacing between the vertical members, or mask strands, of the mask. The method includes providing a tension focus mask comprising vertical mask strands which are held in tension. A permanent adhesive is sprayed on the screen-side of the mask strands followed by the attachment of horizontal guide members to the gun-side of the mask strands with the use of a non-permanent adhesive. Next, permanent horizontal crosswires are applied to the screen-side of the mask strands; subsequently, the mask assembly is placed into an oven and heated to permanently adhere the permanent crosswires to the mask strands and also to remove the temporary guide members from the mask strands as the non-permanent adhesive volatilizes away.

DETAILED DESCRIPTION

Figure 1:
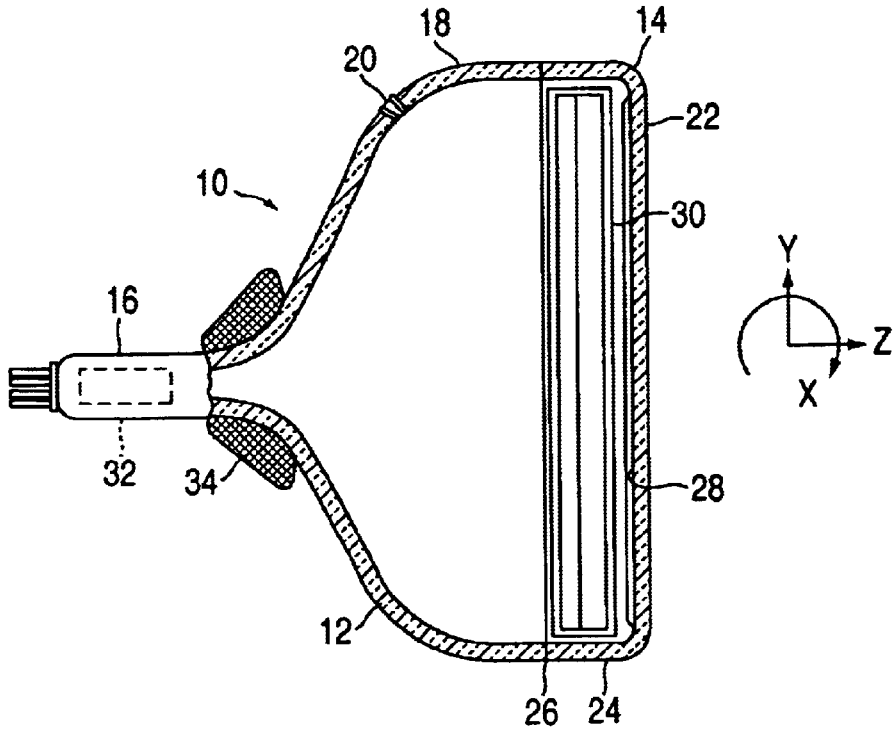
FIG. 1 is a side view, partially in the axial section, of a color picture tube, including a tension focus mask-frame-assembly according to the present invention.

FIG. 1 shows a cathode ray tube 10 having a glass envelope 12 comprises a rectangular faceplate panel 14 and a tubular neck 16 connected by a rectangular funnel 18. The funnel 18 has internal conductive coatings (not shown) that extends from an anode button 20 to a neck 16. The panel 14 comprises a viewing faceplate 22 of a peripheral flange or sidewall 24 which is sealed to the funnel 18 by a glass frit 26. A three-color phosphor screen 28 is carried by the inner surface of the faceplate 22. The screen 28 is a line screen with the phosphor lines arranged in triads, each triad including a phosphor line of each of the three colors. A tension focus mask 30 is removably mounted in a predetermined spaced relation to the screen 28. A tension focus mask has a different voltage applied to the mask strands and crosswires during tube operation. The electron guns (not shown in the diagram) within the dashed lines 32 are centrally mounted within the neck 16 to generate three in-line electron beams, a center beam and two side beams, along convergent paths through the mask 30 to the screen 28.

The tube 10 is designed to be used with an external magnetic deflection yoke, such as the yoke 34 shown in the neighborhood of the funnel to neck junction. When activated, the yoke 34 subjects the three beams to magnetic fields which cause the beams to scan horizontally and vertically in a rectangular raster over the screen 28.

Figure 2:
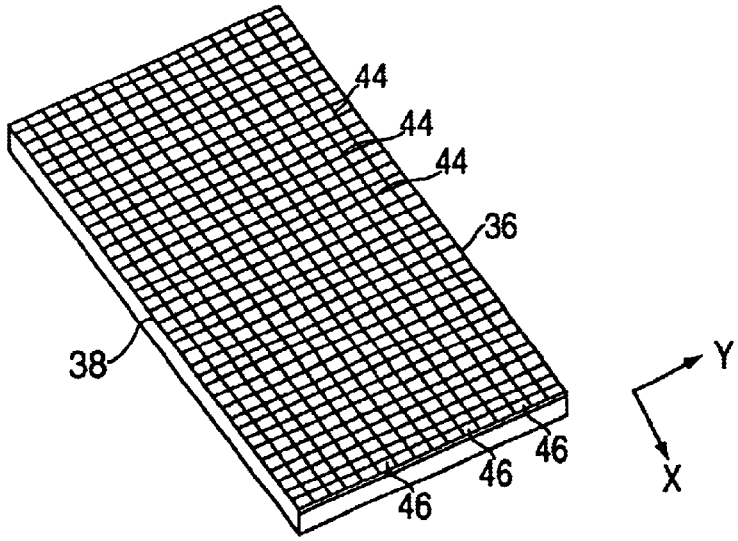
FIG. 2 is a perspective view of the tension focus mask-frame-assembly of FIG. 1.

The tension focus mask 30, shown in greater detail in FIG. 2, includes two long sides 36 and 38 and two short sides 40 and 42. The two long side borders 36 and 38 of the mask are parallel to a central major axis, x, of the tube and perpendicular to a central minor axis, y. The tension focus mask 30 includes two sets of conductive members: mask strands 44 that are parallel to the central y axis and to each other; and crosswires 46, that are parallel to the central major axis x and to each other. In a preferred embodiment, the mask strands 44 are flat strips that extend vertically (parallel to y axis), having a width of about 0.015 inches and a thickness of about 0.002 inches, and the crosswires 46 have a round cross section, having a diameter of 0.001 inches and extend horizontally (parallel to x axis). In the completed mask, the mask strands, which are held in tension, and crosswires are separated from each other by suitable insulator layers such as a lead-based frit.

Figure 3:
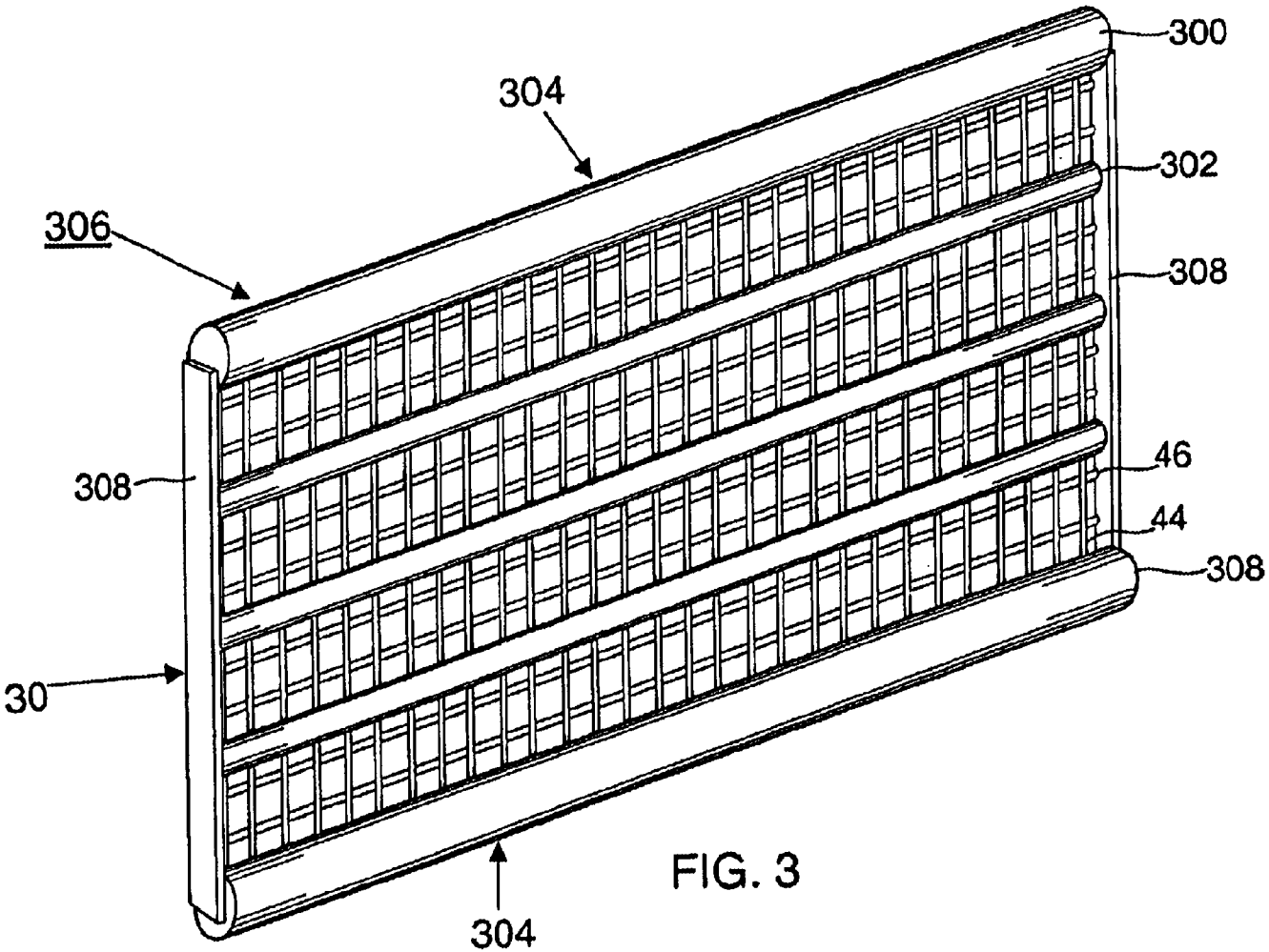
FIG. 3 is a perspective view of the apparatus of the present invention.

FIG. 3 illustrates the tension focus mask 30 with the novel non-permanent horizontal guide members 302 on the first side, or otherwise known as gun-side, of the tension focus mask 30. The guide members 302 maintain the uniform spacing between the mask strands 44 during the application of the permanent, horizontal crosswires 46 onto the second side, or otherwise known as the screen-side, of the tension focus mask 30. The mask frame 306 of the tension focus mask 30 includes two long sides 36 and 38, which contain cantilevers 304 to which the vertical mask strands 44 are attached. The mask frame 306 further contains two short sides 40 and 42 which contain busbars 308. Busbars 308 are structural components to which the crosswires 46 are terminated. The mask strands 44 are positioned such that the last gap near the busbar 308 is well-controlled, similar to the space between each of the vertical mask strands 44. The novel non-permanent guide members 302 are attached so as to stabilize and maintain the uniform spacing of the mask strands 44 and to provide a measure of stability during the crosswire 46 application process. The guide members 302 may be of any suitable cross-sectional shape, such as a flat, thin member or a cylindrical member. Examples include a flat, thin member which can have a thickness of 0.002 inches and a width of 0.015 mils or cylinder shape which can have a diameter of 0.005 inches. These non-permanent guide members 302 are then attached to a first side, or otherwise known as the gun-side, of the focus tension mask 30 prior to the crosswire application. The guide members 302 are attached by means of an organic adhesive such as an acrylic resin dissolved in a suitable solvent, such as amyl alcohol. Such adhesives have low bake-out temperatures which later allow for easy removal of the guide members 302 during a thermal cycle. After the guide members 302 are attached, the screen-side crosswires 46, are applied on top of the mask strands 44.

Under normal processing, the mask strands 44 would be displaced or distorted during the application process. However, the guide members 302 prevent the displacement of the mask strands 44 during the crosswire 46 positioning and attachment process. The crosswires 46 are adhered to the second side of the mask through the use of an insulating adhesive layer. A suitable method for adhering the guide members 302 and crosswires 46 is as follows: (1) a base coat of an insulator material such as a lead-based frit is applied to the second side of the mask; (2) the mask is baked; (3) a top coat of an insulator material such as a lead-based frit is also applied to the second side of the mask; (4) an adhesive is applied to the guide members 302 (5) the guide members 302 are then positioned perpendicular to the strand 44 and then adhered to the first side of the mask; (6) the crosswires 46 are then applied onto the second side of the mask such that they are also perpendicular to the mask strands 44; and (7) the assembly is then baked so that the crosswires 46 are bound to the mask strands 44 by the cured frit and that the adhesive on the first side of the mask volatizes and the guide members 302 detach.

During the heating process, which cures the frit, the guide members 302 detach because the temperatures reached are sufficient to bake-out the adhesive on the first side of the mask. A peak temperature of 450° C. is maintained for about 1 hour.

After the baking cycle is complete, the mask assembly is allowed to cool. At approximately room temperature, the mask assembly is removed from the oven unit and guide members 302 which have detached are then discarded. The tension focus mask 30 is then checked to make sure that the crosswires 46 have maintained their uniform spacing during the baking process. After the check is completed, the tension focus mask 30 is then ready for insertion into faceplate panel 14 and the subsequent assembly is processed in a cathode-ray tube 10 of FIG. 1.

As the embodiments that incorporate the teachings of the present invention have been shown and described in detail, those skilled in the art can readily devise many other varied embodiments that still incorporate these teachings without departing from the spirit of the invention.

What is claimed is:

1. A tension focus mask in a color cathode ray tube having a faceplate with color emitting phosphor stripe screen, a mask frame having two cantilever support structures and securing said mask frame on said faceplate adjacent said screen, a plurality of mask strands being secured to said support structure in tension, an apparatus comprising;

at least one guide member temporarily secured across said mask strands whereby said guide member causes said strands to maintain generally uniform spacing to permit registration with said color emitting phosphor.

2. The apparatus of claim 1, wherein the guide member is adhered with a first type of adhesive and the crosswires are adhered with a second type of adhesive where the first and second adhesives are different.

3. The apparatus of claim 2, wherein the first type of adhesive has different properties than the second type of adhesive.

4. The apparatus of claim 1, wherein the guide members are of a substantially flat.

* * * * *